United States Patent [19]

Nickel

[11] Patent Number: 4,899,901

[45] Date of Patent: Feb. 13, 1990

[54] CONTAINER ARRANGED WITHIN A STACKING FRAME

[75] Inventor: Klaus-Dietrich Nickel, Frankfurt am Main, Fed. Rep. of Germany

[73] Assignees: KASA-TECHNOPLAN GmbH; INNOPLAN-Ingenieurgesellschaft Braas und Co. mbH, both of Frankfurt am Main, Fed. Rep. of Germany

[21] Appl. No.: 189,305

[22] Filed: May 2, 1988

[30] Foreign Application Priority Data

Apr. 30, 1987 [DE] Fed. Rep. of Germany ..... 37143964

[51] Int. Cl.[4] ..... B67D 5/64

[52] U.S. Cl. ..... 220/5 A; 222/167

[58] Field of Search ..... 220/5 A; 222/162, 167, 222/183, 411

[56] References Cited

U.S. PATENT DOCUMENTS

| | | | |
|---|---|---|---|
| 1,655,753 | 1/1928 | Cole | 222/411 |
| 2,000,631 | 5/1936 | Windecker | 214/83 |
| 2,436,959 | 3/1948 | Ekin et al. | 222/167 |
| 2,720,340 | 10/1955 | Gustafson | 222/167 |
| 2,797,070 | 6/1957 | Winn, Jr. et al. | 222/167 X |
| 3,901,411 | 8/1975 | Bauman | 222/167 |
| 3,912,103 | 10/1975 | Gerhard | 220/5 A X |

*Primary Examiner*—Steven M. Pollard

*Attorney, Agent, or Firm*—Toren, McGeady & Associates

[57] ABSTRACT

A container that is arranged on rollers and can be rotated by either rotary drive system or manually about its longitudinal axis within a stacking frame is configured as a body of rotation and provided inside with a mechanical delivery and fluidizing system. One of the container bottoms serves as a voiding bottom and is combined with a voiding system that comprises a passage for the bulk material that passes through a central opening in the voiding bottom. The opposite container bottom serves as a pressure-equalizing bottom and is combined with a pressure-equalizing system.

43 Claims, 6 Drawing Sheets

Figure 1:
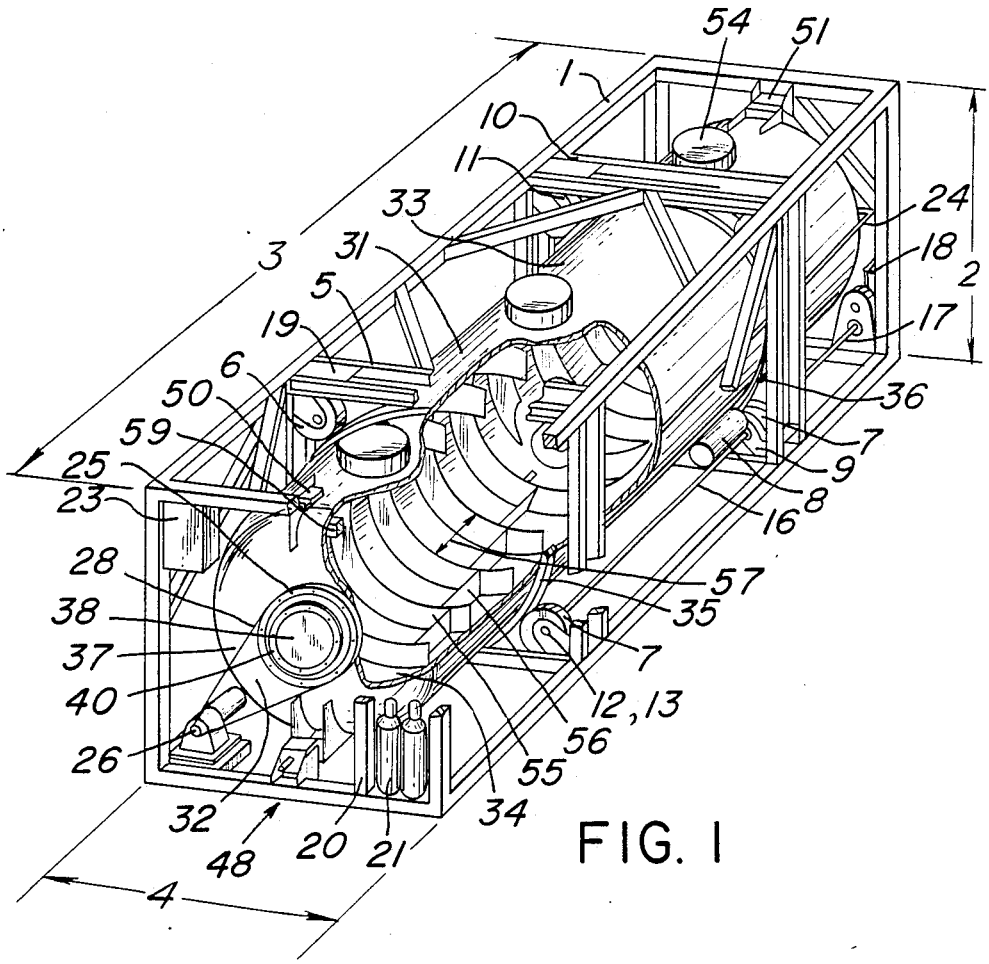

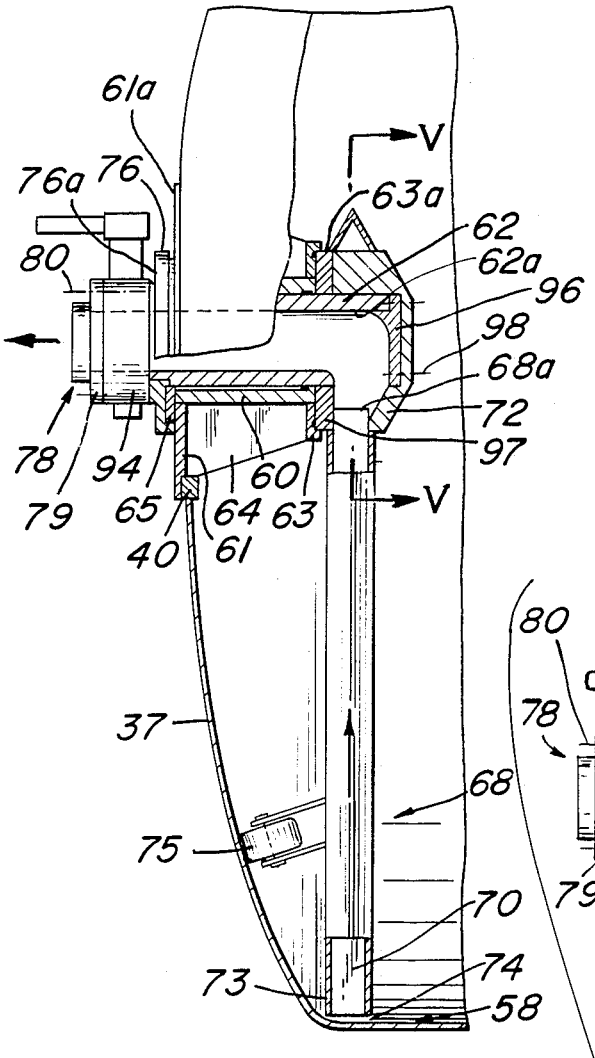
FIG. 4
FIG. 5
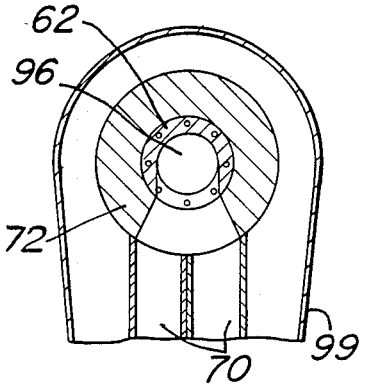
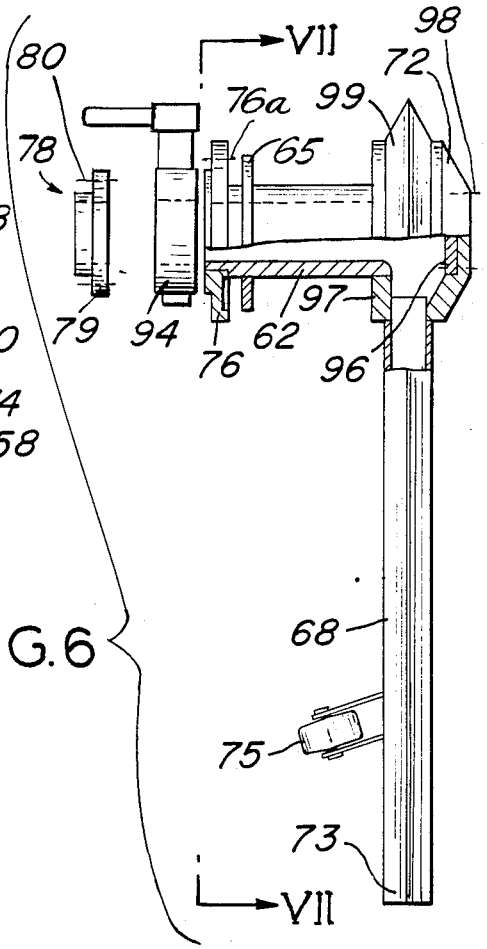
FIG.6

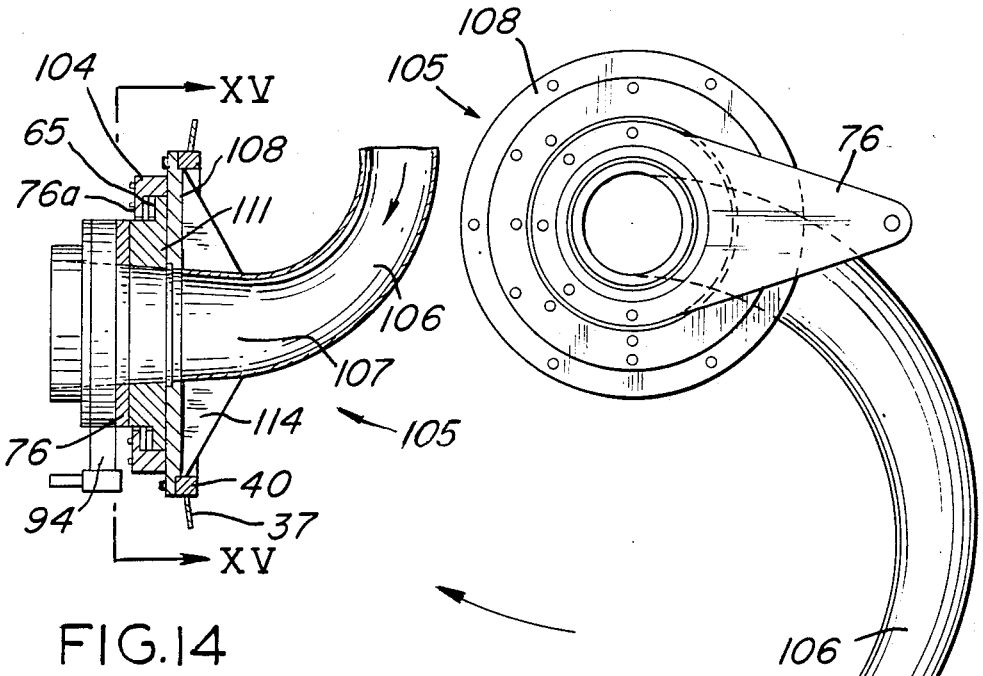
FIG.14
FIG.15
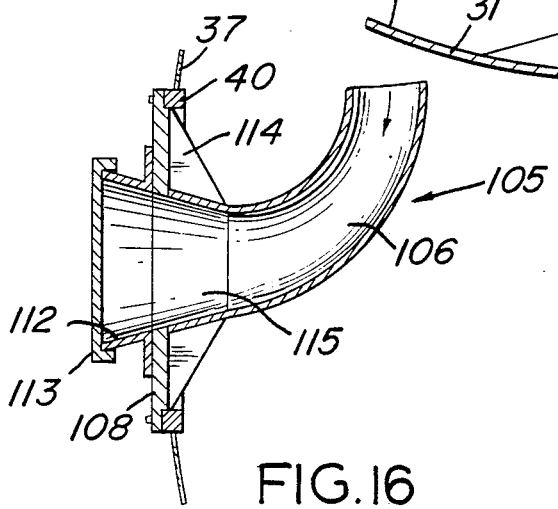
FIG.16

CONTAINER ARRANGED WITHIN A STACKING FRAME

The present invention relates to a cylindrical container having a curved or flat container bottom, said container being arranged within a stacking frame and used for bulk materials, preferably of the consistency of very fine powder, and having at least one filler, a voiding system, and a pressure-equalising system.

The stacking frames for such transportation containers, known as silo containers, are built to ISO/UIC standards or to dimensions laid down by the railways. Bulk goods can be transported by rail, road or water in them, on suitable vehicles. Known silo containers are filled through fillers that are accessible from above, through the stacking framework. Total voiding can be effected—depending on the size of the container—through four, six or eight special outlets, using compressor systems that are installed on the container chassis or are permanent installations that generate 2 atmospheres, for example. In addition, many silo containers have to be tilted up to 50° so as to empty problem bulk materials. Such containers then have a special voiding system (see prospectus from Spitzer Silo-Fahrzeugwerke, D-6950 Mosbach bei Heidelberg).

Known silo containers are used exclusively to move bulk materials, for example, between a supply silo behind a mill or a reduction plant and another supply silo at another processing facility. Between the reduction plant and the secondary processing plant the bulk material must first be moved into the first supply silo, then—as required—moved from this into the silo container to be moved, and then, before further processing is done, moved from this silo container through a system so as to be replaced in a further supply silo. This requires considerable resources with regard to space, plant, and time.

Difficulties of a particular kind result with problem bulk materials, such as very fine powders, for these flow very poorly during the voiding process, or else are inclined to agglomeration and bridging. Special voiding aids such as pneumatic fluidising bottoms or the like have been developed for supply silos in order to avoid these difficulties, but their incorporation into silo containers makes such containers considerably more costly. Quite apart from this, the incorporation of fluidising bottoms reduces the useful volume of such containers and increases the plant costs associated with voiding such containers.

For this reason, up to now for example, costly bulk containers with built-in fluidising inlets has been used to transport bulk materials that flow very poorly (AZO-Container-inlet, AZO Maschinenfabrik Adolf Zimmermann, D-6960 Osterburken). However, these bulk containers have not been satisfactory since they are often unusable after short while as a result of the scouring action of the bulk material during transportation. Such bulk containers are not suited for direct connection to a secondary processing phase because continuous voiding is not possible without constant tilting, so that they have first to be emptied into an intermediate silo.

In addition to this, even though they can be stacked, known silo containers cannot be emptied when so stacked, particularly on container ships or in container terminals, because of the dimensions of their stacking frames.

This feature of silo containers known up to now is particularly disadvantageous during the intermediate storage or intermediate transportation of materials in the form of fine powder that is sensitive to moisture. Each time such bulk materials are moved to another container they come into contact with atmospheric air, whereupon the material, essentially dry after the reduction process, absorbs moisture that has to be removed from them, often at great cost, prior to continued processing.

In contrast to this, it is the task of the present invention to optimize the accommodation of bulk materials, in particular of problematic fine powders, between a reduction plant and a secondary processing facility.

It has been found that this task can be solved in a surprisingly simple manner in that the container, accommodated in a stacking frame, supported on rollers, and rotatable by a drive system or manually about a longitudinal axis, is a body of revolution; in that within the container there is a combined mechanical delivery and fluidising system; in that one of the container bottoms is configured as a voiding bottom and combined with a voiding system that includes a duct for the bulk material that passes through a central opening in the voiding bottom; and in that the opposite container bottom is configured as a pressure-equalising bottom and combined with a pressure-equalising system.

A container of this kind can be filled with essentially dry bulk material, preferably fine powders, thorough its filler connections, directly from the closed system of a reduction plant, using a new filling system that is not part of the present invention; then, if necessary, such material can be kept in intermediate storage for as long as required or transported by water, rail, or road by whatever means is needed, and over very long distances.

Even in the case of longer storage periods, the finest bulk material within the container will not be rendered unusable, either by agglomeration of by any chemical processes that could take place, since both can be interrupted or prevented by brief rotation of the container, even if there is some residual moisture within the bulk material. This bulk material, above all very fine powders, can be passed on—without picking up any moisture—directly and continuously to a subsequent secondary production process by using various container-voiding systems that have been adapted to current practice.

No additional gas, supplied from an external source, is needed to fluidize the bulk material within the gas-tight container. On the contrary, the quantity of gas that is brought in with the free-flowing fine powder as the container is being filled is sufficient. Should additional gas be required for fluidising, for whatever reason, this is managed by the pressure-equalising system that is fitted to the container.

Fluidising is needed before the container is voided if the bulk material has compressed as a result of gas separation (approximately 15 to 18% loss of volume) caused by agitation of the material during transportation. Because of the fluidising paddles within the container, the bulk material is agitated during rotation of the container and is thereby brought into contact with the gas bubbles that have shifted to its upper areas, whereupon the gas particles are once more deposited on the surface of the solid particles. This renders the bulk material free-flowing. There is no supplementation of the moisture content beyond the extent that was present when the container was filled, for example, from the closed system of a reduction plant.

These new containers can be stacked either adjacent to or above each other. If one assumes that each container can contain some 30 tonnes of bulk material, and four such containers are to be stacked one above the other, then each stacking frame must be able to support some 100 tonnes (filling plus weight of container itself). Because of the fact that the containers can be voided through a central duct in the central opening in its voiding bottom, the battery-stacked containers can be connected without any difficulty to a pipe system [that leads to other destinations—Tr.] and continuously voided through this, in which regard, the delivery and fluidising system within the container permits and assists almost complete voiding.

Prior to being filled with bulk materials that are potentially explosive, the container is flushed with inert gas. It remains filled with this inert gas to a pressure of 0.2 bar, and is thus rendered inert. The inertialisation [sorry—Tr.] system that forms part of the container is controlled by an oxygen-content monitoring system that maintains the oxygen content constant at approximately 6%.

Demoisturized gas (depending on the explosion hazard associated with the bulk material in question, either air or inert gas) can be used exclusively as feed gas to equalise the pressure when the container is being voided, if the residual moisture content of the bulk material that is to be processed further is not to deteriorate.

In order to be able to ground any static electricity caused by under some circumstances during the fluidising process by friction, the container is grounded through the stacking frame. The stacking frame or the container is fitted with a transportation safety system the keeps the container secure in the stacking container even in the event of violent braking or unforeseen manoeuvres. The transportation safety system can be so interconnected with the initiation of the rotary drive that this drive can only be switched on once the transportation safety system has been released.

The container can be supported on rollers and its rotary drive can be effected in a number of ways. In a first embodiment, a roller ring and a separate drive ring are secured to the container to this end. Each roller ring is secured to the outer casing and each runs on four rollers, each of which is secured within a roller frame of the stacking frame. The roller ring is paired with a drive element that is connected with the rotary drive through a reduction gearing. The pairing between the drive ring and the drive element can be in the form of a gear ring, a pair of pinions, a pair of connecting rods [Treibstock—?—Tr.], a chain, or a pair of worm gears. In the latter case, the reduction gearing is in the form of an angle drive.

In another embodiment, two roller rings are provided on the outer casing of the container. Each of this roller rings in actively connected to three rollers and a drive wheel. The rollers and the drive wheels are each supported in the corners of a roller frame of the stacking frame. At least one of the drive wheels supported in a lower corner of the roller frame is connected to the rotary drive through a reduction gearing. Both drive wheels can be connected to each other through a drive shaft.

Under some circumstances, it is necessary that two roller rings, each with three rollers and a drive wheel, be provided for each roller frame. It is also advantageous if the drive wheels be fitted with a rim of hard rubber. The reduction gearing can be connected to a hand crank so that in the event of a power failure, or when in a location where the container's rotary drive cannot be connected to electrical power, it will still be possible to void the container.

The rotary drive comprises a motor that is installed in the stacking frame, and which is controllable. With this, it is possible to void a container or even all the containers stacked in a battery, for example, under the control of a process computer and, if so desired, match it to a secondary processing stage.

The combined mechanical delivery and fluidising system comprises one or a plurality of spiral baffles that are installed between the container bottoms on the inside casing, between which, there are fluidising paddles that are offset relative to each other in the direction of the longitudinal axis of the container. The slope of the spiral baffles can decrease towards the voiding bottom. When the container rotates the bulk material is agitated by the fluidising paddles, and because of the spiral baffles the bulk material will also be moved towards the voiding bottom. Because of the configuration of the spiral baffles it is possible to influence the speed of movement in connection with the rotation of the container as a function of the nature of the bulk material involved, for which the container is intended in a particular case. The essential of the various voiding systems connected with the container is the material duct that is led through the central opening in the voiding bottom, which makes it possible to empty a rotating container.

In a first embodiment, the voiding system is a vacuum [suction] voiding system, the duct for which, which passes through the voiding bottom, is a rotating duct, at the end of which there is a suction connector and at the inner end of which is connected a suction nozzle that is directed upwards even when the container is rotating, the lower end of which ends in a bulk material collection area. Before voiding through this suction voiding system begins, the bulk material, which may have become compacted under some circumstances, must be loosened and rendered free-flowing. This is done in that the container is rotated without the suction voiding system being switched on. The suction voiding system, in particular the rotating duct, is combined with a so-called thrust plate which means, in essence, that the suction connection of the voiding system remains stationary relative to the stacking frame even when the container is rotating. Details of the suction voiding system are set out in claims 12 to 20.

A second embodiment of the voiding system is configured as a mechanical voiding system that incorporates a paddle arrangement that is secured to the inner side of the voiding bottom. The duct in the voiding bottom, which is combined with this voiding system, is a rotating duct. Details of this voiding system are set out in the claims 24 to 29.

A third, relatively simple embodiment of a mechanical voiding system is described in claims 30 to 34. This voiding system operates independently of stationery auxiliary systems or electrical power. Voiding is effected solely by the rotation of the container within the stacking frame which, in an emergency, can be rotated manually.

In all cases, during voiding, there has to be an equalisation of pressure, and this is combined with the pressure-equalising base. Essentially, this comprises a gas duct, the gas duct receptacle for which, secured in the centre of the pressure-equalising base, is connected through connecting lines (which are in a star-shaped layout) that are directed outwards, to gas ducts that are located at the outer edge of the pressure-equalising bottom in the interior of the container, with a gas line being connected to those of their elements that are stationary relative to the stacking frame. This gas line can be connected to compressed air or gas cylinders that are arranged in the stacking frame, or to a simple air inlet valve; this latter solution can only be used in those cases when the properties of the bulk material are such that it is permissible for it to come into contact with atmospheric air when it is being unloaded.

Each gas duct that is located in the vicinity of the periphery of the pressure-equalising bottom is combined with a shut-off valve, the operating pushrod for which lies—for the duration of the gassing phase—against a control cam that is secured to the stacking frame. The arrangement is such that gassing takes place only if and when the shut-off valve that is in operation passes by in the upper area on the control cam.

In containers that are to be used to transport and store hazardous bulk materials, there can be an $O_2$ monitoring point within the container, and this can be connected electrically with the control valves on the gas cylinders. If the $O_2$ content within the container becomes too high, inert gas can be injected into the container automatically.

It is advantageous that the filler connectors, the voiding systems, and the pressure equalisation system be hermetically sealed against the atmosphere.

Using the container that is supported so as to be able to rotate within a stacking container it is possible to avoid all the disadvantages that had to be accepted during the intermediate storage and the transportation of fine powders, such as additional costs incurred, space requirements and capacity for refilling and intermediate handling, as well as the risks associated with the uncontrolled absorption of moisture during transfer filling and intermediate delivery. The container according to the present invention can be used as a supply container for bulk material, as a transportation container for long-distance moves, and as a storage container with its own voiding system—with no need for the container to be tipped or tilted, as a removal container for secondary processing of the bulk material, in which regard the container according to the present invention permits an optimum charge.

Embodiments of the present invention are described in detail below on the basis of the drawings appended hereto. These drawings show the following:

FIG. 1: An isometric overall view of the container.

Figure 1A:
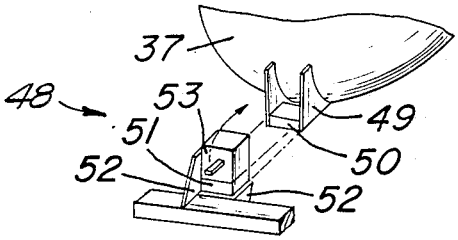

FIG. 1*a*: Details of the transport safety system.

Figure 2:
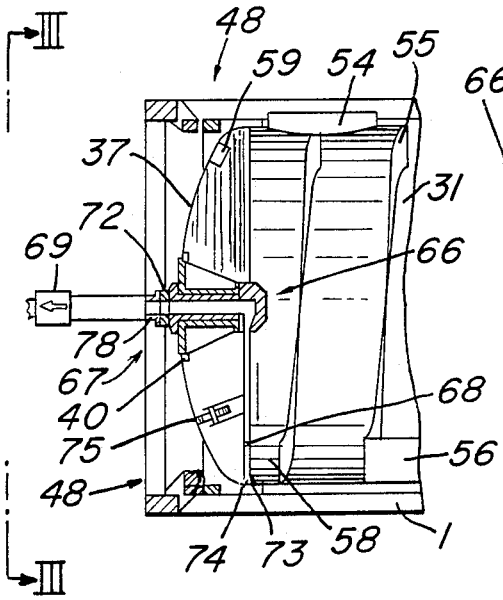

FIG. 2: A cross-section through a first embodiment of a voiding system on the line II/II in FIG. 3.

Figure 3:
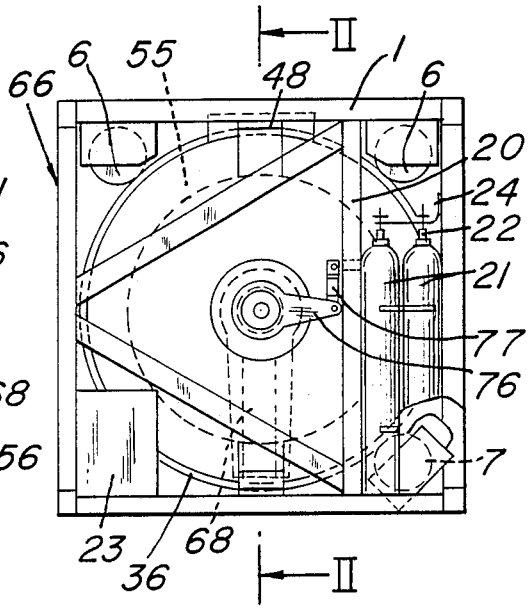

FIG. 3: A view of the voiding system as in FIG. 2, on the line III/III in FIG. 2.

FIG. 4: An enlarged cross-section through the embodiment in FIG. 2.

FIG. 5: A structural detail as a section along the line V/V in FIG. 4.

FIG. 6: Details of the first embodiment of the voiding system.

Figure 7:
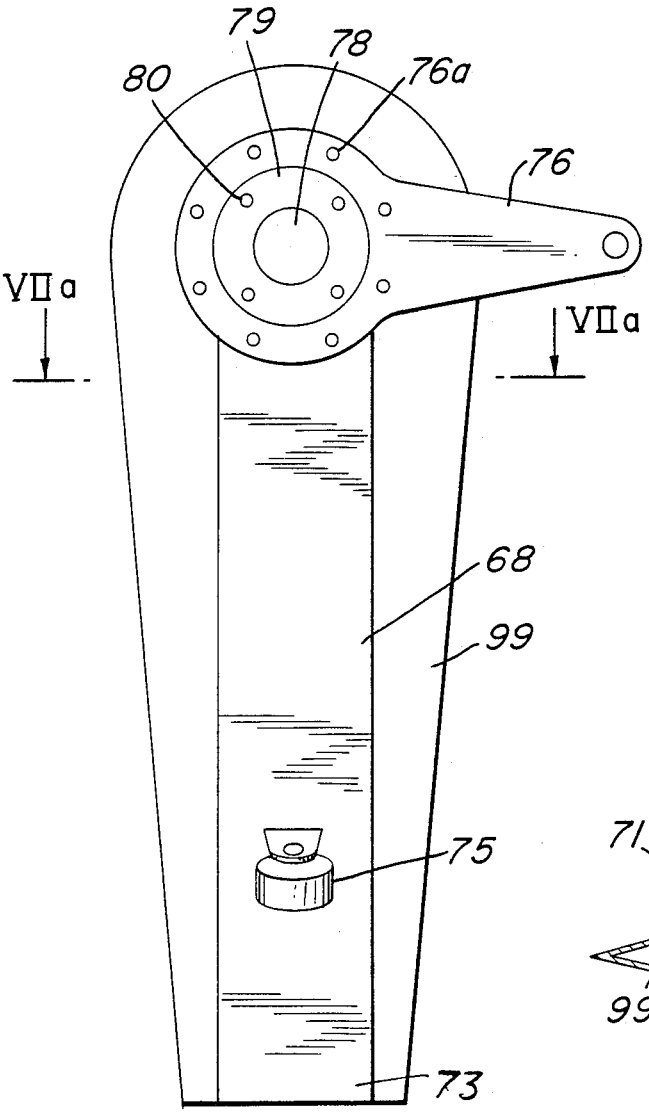

FIG. 7: A suction nozzle, as viewed from the front.

Figure 7A:
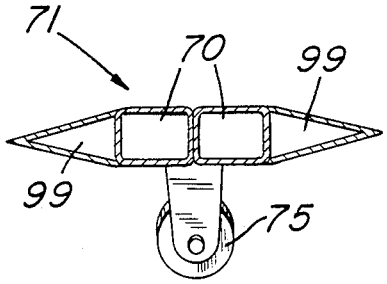

FIG. 7*a*: A cross-section through FIG. 7 on the line VIIA/VIIA.

Figure 8:
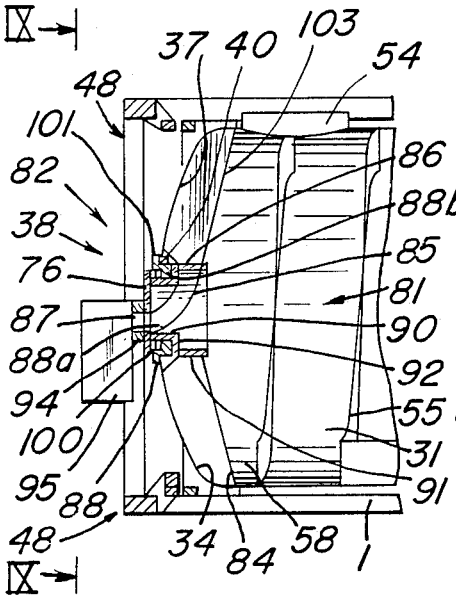

FIG. 8: A cross-section through a second embodiment of a voiding system on the line VIII/VIII in FIG. 9.

Figure 9:
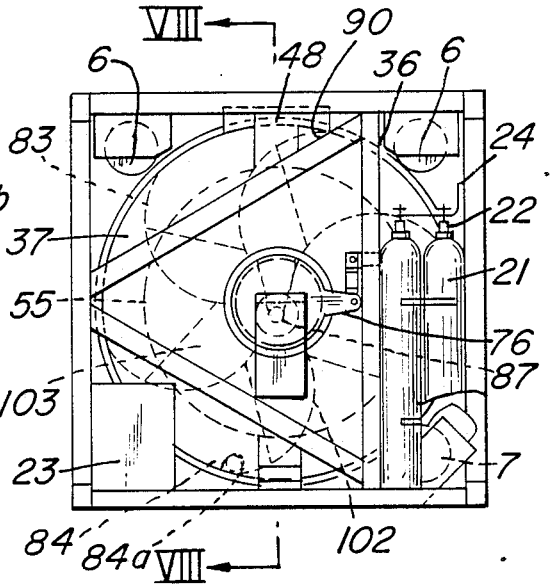

FIG. 9: A view of the voiding system on the line IX/IX in FIG. 8.

Figure 10:
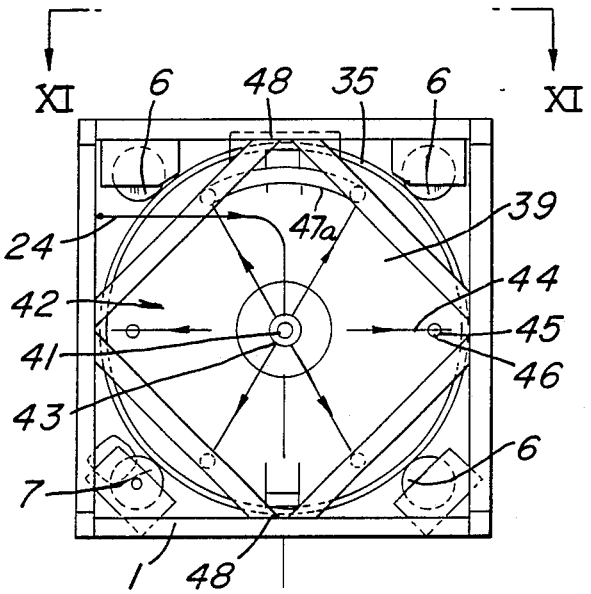

FIG. 10: A view of a pressure-equalising system on the line X/X in FIG. 11.

Figure 11X:
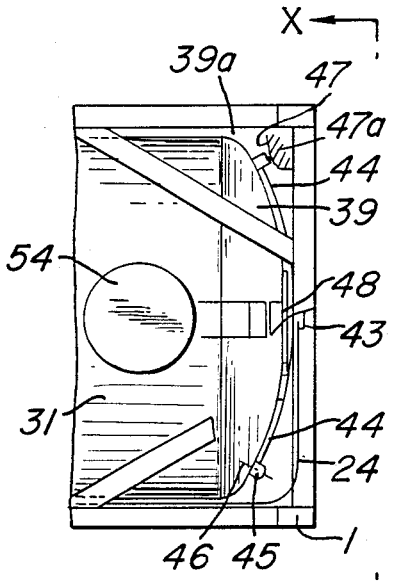

FIG. 11: A plan view of a pressure-equalising system on the line XI/XI in FIG. 10.

Figure 12:
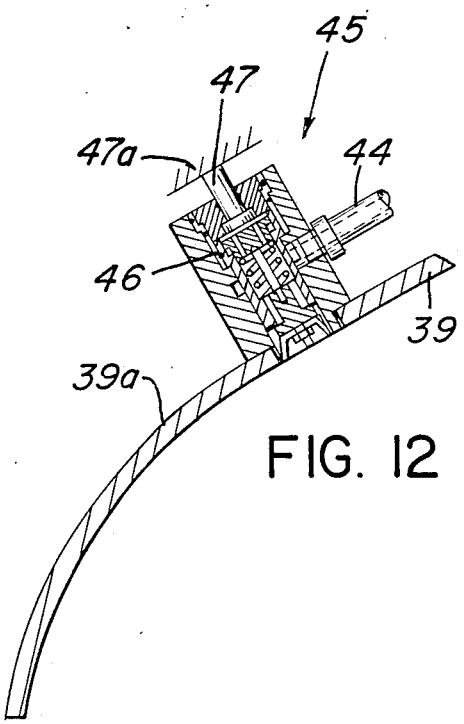

FIG. 12: A detail of a pressure-equalising system.

Figure 13:
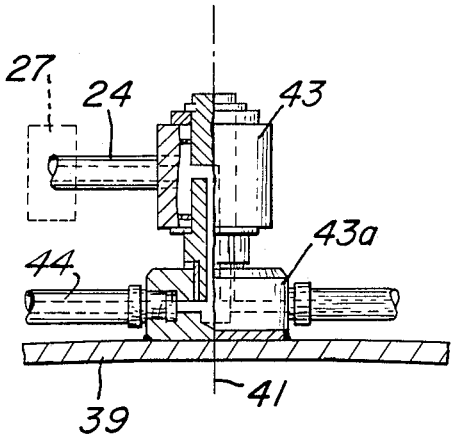

FIG. 13: A further detail of the pressure-equalising system.

FIG. 14: A cross-section through a third embodiment of a voiding system.

FIG. 15: A cross-section through FIG. 14 on the line XV/XV.

FIG. 16: A simple variation of the voiding system as in FIG. 14.

FIG. 1 is an isometric overall view of a cylindrical container 31 with a curved bottom, this container being supported so as to be able to rotate within a stacking frame 1; a voiding bottom 37 with a central opening 38 that is enclosed within a reinforcing ring 40 can be seen in this drawing.

The stacking frame is built in the usual way from struts and is of height 2, length 3 and width 4. Depending on its intended role, the height 2, length 3 and width 4 can be in accordance with ISO or UIC standards. The sizes can, however, be matched to the dimensions set out by a railway system, for example.

The stacking frame 1 has a first roller frame 5 and a second roller frame 10. In the embodiment shown, there are three rollers 6 in each roller frame 5 or 10, respectively, each such roller being installed in al lower corner of the roller frame, and a drive wheel 7. The drive wheels 7 are driven by a motor 8 through a reduction gearing 9. Between the drive wheels 7 of the two roller frames 5 and 10 there is a drive shaft 16 so as to make it possible to transmit the rotary drive to two roller rings 35 and 36, which are secured to the outer casing 33 of the container 31, with the force from only one motor. The rollers 11 that are installed in the rolling frame 10 correspond to the to the rollers 6 in the rolling frame 5. Normally, the axles 12 of the rollers 6 or 11 and the axles 13 of the drive wheels 7 are supported, unsprung, in each corner of their roller frame 5 or 10. For special purposes, the axes of rotation 12 of the rollers 6 or 11 that are supported in the upper corners of the roller frames 5 and 10 are supported by contact springs (not shown herein) so as to prevent any noisy movement of the container 31 within its stacking frame 1.

FIG. 1 shows that the reduction gearing 9 is connected through a manual-drive shaft 17 to a hand crank 18 that in its turn can work through a reduction gearing on the manual-drive shaft 17. This makes it possible to rotate the container in the event of a power failure.

In each of the roller frames 5 or 10 there are so-called roller mountings 19 that provide appropriate support for the rollers as well as for the drive wheels 7.

Each of the drive wheels 7 can have a rim (not shown herein) of hard rubber or the like so as to provide for surer transmission of torque onto the container 31. In special cases each roller frame 5, 10 can have two roller rings 35, 36, each with three rollers 6, 10 and a drive wheel 7 to transfer the torque from the reduction gearing 9 onto the container 31. At least one of the roller rails 35, 36 is U-shaped and simultaneously serves as an axial guide when the container 31 is rotating.

In the front part of FIG. 1 there is a supporting strut 20 with the gas cylinders 21 being arranged adjacent to this. As will be explained later, these gas cylinders can be filled with air or with an inert gas.

A switch box 23 contains the essential components of the electrical or electronic control system for the new container.

The gas cylinders 21 are connected as will be explained below through a gas line 24 to the pressure-equalising system 42 as shown in FIGS. 10 to 13.

In a further embodiment of a rotary drive for the container 31 the motor 8 acts on the container 31 through a reduction gearing 9, a drive ring 25 and a drive element 26. In this case, the rollers 6 or 11, respectively, are supported in all four corners of the roller frame 5 or 10, respectively. FIG. 1 shows the pairing of a drive ring 25 and a drive element 26 through a chain 28. Without modifying any part of the concept of the present invention, the rotary drive can be effected through a serrated bar or a toothed chain. For one embodiment, it is foreseen that the drive element 16 is configured as a worm wheel and the drive ring as a worm-drive annulus. In this case, the reduction gearing 9 is configured as an angle drive. These drives, too, are connected through the manual-drive shaft 17 to the hand crank 18 so that the container 31 can also be rotated manually in an emergency.

The tubular container 31 has a longitudinal axis 32, an outer casing 33 and an inner casing 34. In addition, filler caps 54 can be seen; the container 31 is filled with bulk material through these. The filler caps 54 are of such a size that a man can pass through them into the interior of the container 31 in order to clean it, for example, with water. When this is done, the container 31 can be so secured in the stacking frame that the fillers 3 are directed downwards so as to permit the cleaning water can drain out of them.

One or a plurality of spiral baffles 55 are secured on the inner casing 34 of the container 31; in the gap 57 between these baffles 55 there are fluidising paddles 56, these being secured therein so as to be offset relative to each other and aligned with the longitudinal axis 32. These fluidising paddles 56 effect an intensive fluidising of the bulk material, which can under certain circumstances become compacted during transportation, when the container 31 is rotated. When this happens, gas particles are deposited from the upper area of the interior of the container onto the particles of the bulk material, which means that the bulk material regains its original free-flowing state, which it had lost during transportation, as a result of degassing brought about by vibration.

FIG. 1*a* shows a lower part of the transport safety system 48. This consists essentially of a container brake shoe 50 and a frame brake shoe 51 that is opposite this. With the container 31 in the position shown in FIG. 31, both brake shoes 50 and 51 lie opposite each other within the stacking frame 1. When the container 31 rotates within the stacking frame, the brake shoes 50 and 51 can pass each other unhindered, as is shown, for example, in FIG. 2.

The container brake shoe 50 is secured between two stiffening plates 49, and the frame brake shoe 51 is secured between two stiffening plates 52 that are welded to a crosspiece (not shown herein) of the stacking frame 1.

The whole of the transport safety system of the container 31 consists of four units 48. For each container base 37 or 39, respectively there is an upper part of a transport safety system and a lower part of the transport safety system 48. Both lower parts of the transport safety system 48 have a rotating shoe 53 above the frame brake shoe 51, as can be seen in FIG. 1*a*, and this is supported in extensions of the stiffening plate 52. When the container is being transported the rotating shoe 52 is pivoted in the direction indicated by the arrow in FIG. 1*a*, when it moves between the stiffening plates 49, which prevents rotation of the container 31 and ensures that brake shoes 50 and 51 are opposite each other.

Within the container 31 there is an oxygen-content monitoring system that can indicate the oxygen content within the container 31. If this oxygen content becomes too great, there is a danger of explosion of the bulk material within the container 31. For this reason, operation of the control valves 22 is initiated by an electronic control system, for example, within the control box 23; these control valves are located atop the gas cylinders 21. If these gas cylinders 21 are filled with inert gas, it is possible to ensure that the dangerous atmosphere within the container 31 is rendered innocuous.

Without modifying any part of the concept of the present invention, a comparable sensor can also regulate the introduction of dry air into the interior of the container should additional air from the cylinders 21 be needed to activate the particles of bulk material.

The voiding bottom that is numbered 37 in FIG. 1, mainly its central opening 38, serves to accommodate three different voiding systems 66, and 81 or 105, respectively. A first embodiment of a voiding system is described on the basis of FIGS. 2 to 7*a*.

FIG. 2 shows a simplified cross-section through the voiding system 66. This has a rotary duct that bears the group reference number 67; at the inner end of this a suction nozzle 68, and at its outer end a suction pump 69 are connected or can be connected. The suction pump 69, which is only represented schematically, can be a fine-powder pump.

Details of the voiding system 66 will now be described on the basis of FIGS. 4 to 7*a*. The rotary duct 67 consists of a bearing tube 60 that has an outer flange 61 and an inner flange 63. Between the outer flange 61, the inner flange 63, and the bearing tube 60 there are stiffening ribs 64, as can be clearly seen in FIG. 4. The outer side of the outer flange 61 is configured as a bearing and sealing flange 61*a*.

A passage tube 62 is supported so as to be sealed and rotatable within the bearing tube 60, and the front end of this protrudes from the bearing tube 60. A thrust plate 76 is secured to this protruding end of the passage tube 62, as can be seen in FIG. 7. This thrust plate 76 is sprung against the stacking frame; within this support, which will not be described in detail, there can be a switch 77, this being arranged in the circuit of the motor 8. If the load on the suction nozzle 68 becomes to great during rotation, because of the pressure of the bulk material, the motor can be switched off, particularly if the rotary drive 25, 26, 28 is provided, this being done to prevent overload. This switch 77 can be dispensed with if, for example as shown in FIG. 1, the rotary drive is effected by way of drive wheels 7. In the event of an overload, such drive wheels would simply skid without endangering the motor by so doing.

A spacer ring 65 is installed on the passage tube 62, and this is arranged between the thrust plate 76 and within the outer flange 61 of the bearing tube 60. There are grub screws 76*a* in the bearing tube, as can be seen from FIG. 4, and these are used to adjust the distance between the thrust plate 76 and the distance ring 65.

A flange 79 of a suction connection 78 is secured to the thrust plate 76 by means of the screws 80, and this also secures a shutoff device 94 between the flange 79 and the thrust plate 76. In the embodiment shown, the shutoff device 94 is a shutoff flap, which is not shown in detail.

The suction pump 69 that is indicated in FIG. 2 can be connected in a known manner to the suction connector 78.

The inner end of the passage tube 62 has a recess that is open at the bottom on the suction nozzle 64, as can be seen in FIG. 5. The passage tube 62 ends in a partial annular surface 62*a* to which an end plate 96 is welded. The diameter of this end plate 96 corresponds to the outside diameter of the passage tube 62. As is shown in FIG. 4, this end plate 96 is so formed as to ensure an adequate transition radius for deflecting the suctioned bulk material between the suction nozzle 68 and the passage tube 62.

A plug-type head 72 is secured by screws 98 to the end plate 96; the upper end 68*a* of the suction nozzle 68 is welded into this head 72. A bearing and sealing ring 97 is welded onto the side of the head 72 that is proximate to the shutoff device 94, and this ensures the solid seating of the suction nozzle 68 in the head 72, and also provides good rotational support relative to the inner flange 63 on the bearing tube. The inner flange 63 is configured as a bearing and sealing ring 63*a* and the side of the bearing and sealing ring 67 that faces this ensures good rotation and a good seal.

The passage tube 62 is supported in a known manner so as to be able to rotate within the bearing tube 60 and is sealed so as to be powder-tight by seals, known per se but not shown in detail herein.

FIG. 7*a* shows that the suction nozzle 68 consists of parallel suction tubes 70 of triangular cross-section 71. In the lower area of the suction nozzle 68 there is a pressure roller 75 which, as is shown in FIG. 4, runs on the rotary voiding bottom 37.

The lower end 73 of the suction nozzle 68 ends in the bulk-material collection area 58 at a distance 74 above the inner casing 34 of the container 31.

FIG. 7 shows that the Suction nozzle 68 and the head 72 are surrounded by an edge 99 of rectangular cross-section that primarily reduces the pressure of the bulk material on the inlet and outlet edges of the suction nozzle 68 when the container 31 rotates.

FIGS. 8 and 9 show a second embodiment of a mechanical voiding system 81. This has a rotary duct that bears the group reference number 82 and a paddle system 83. On the reinforcing ring 40 of the central opening 38 of the pressure-equalising bottom 37 there is a rim 88 with an outer bearing and sealing ring 88*a* and an inner bearing and sealing ring 88*b* flanged onto it. A passage tube passes through the central opening 38 of the voiding bottom 37 that is defined by the rim 88, and this consists of a front passage tube 90 and a passage tube 91 that is extended relative to this, over a sharp transition, by means of a stepup ring 92. Installed on the front end of the passage tube 90 there is an outer flange 100, between which and the outer bearing and sealing ring 88*a* there is a spacer ring 101. The thrust plate 76, which is supported against the stacking frame 1 as in the first example, is adjacent to this. Once again, grub screws 76*a* pass through the central plate of the thrust plate 76, and the distance between the thrust plate 76 and the spacer ring 101 can be adjusted by means of these grub screws. The proper rotational seating of the passage tube 90, 21 relative to the rim 88 is ensured by means of these grub screws.

There is a filler opening 86 in the passage tube 91 and this is always directed upwards as a result of the thrust plate 76. The paddles of the paddle system 83 gradually work the bulk material into this opening, which then collects in the bulk-material collection area 58 as a result of this screw-conveyor action.

The shape of the paddles is shown by the dashed line in FIG. 9. These paddles are of sheet metal 102, and their scoop edges 84 abut against the inside casing 34 of the voiding bottom 37 or of the container 31, respectively. The scoop ends 84*a* are oriented tangentially to the inner casing 34 of the container 31.

The sheet metal elements 102 of the paddles are so curved that the bulk material that this picked up during rotation of the container can always fall. The bulk material reaches the voiding end 84*b* of the paddle arrangement 83 and passes through the filler opening 86 in a delivery tube 85 and from this to the voiding opening 87 that is arranged in the front plate of the thrust plate 76, beneath its centre point. Once again, there is a shutoff device 94 in front of this voiding opening 87, and this is bolted to the base plate of the thrust plate 76. In order to ensure the proper mechanical voiding of the container 31 a voiding system 85 that is configured as a wind shield can be arranged in front of the voiding opening 87 during the voiding process.

FIG. 9 shows the delivery pipe 85 in plan view, by dashed lines. Such a configuration, which tapers down towards the voiding opening 87 is only used in special cases. Normally, the delivery tube widens out in a trumpet shape between the filler opening 86 and the voiding opening so as to avoid any buildup of the bulk material when the container is being voided.

The step-up ring 92 between the passage tubes 90 and 91 is configured as a bearing and sealing ring on its side that faces outwards.

Baffle plates 193 can be fitted in order that the paddle system 83 is not destroyed by the delivery pressure of the bulk material when the container 31 is rotated; these baffles can be seen in plan view in FIG. 9 and in cross-section in FIG. 8.

The second embodiment of the voiding system, described heretofore, can have any number of individual paddles that form part of the paddle system. FIG. 9 shows six such paddles that carry the bulk material delivered from the spiral baffles 55 into the bulk-material collection area. Three or four individual paddles can be used just as well.

FIGS. 14, 15, and 16 show a third embodiment of a mechanical voiding system 105. The essential component of this voiding system is a shovel tube 106, the voiding end 107, 115 of which passes coaxially through the voiding bottom 37. The shovel tube 106 has an end flange 108 that is bolted to the reinforcing ring 40 of the central opening 38. The filler end 109 of the shovel tube 106 is configured as a shovel that lies tangentially against the inner casing 34 of the container 31, and the front end 110 is secured to the container inner casing 34. The shovel tube 106 rotates together with the container 31. It takes the bulk material from the bulk-material collection area 58. As the container 31 rotates, the bulk material within the shovel tube 106 falls continuously and this moves, as can be seen from FIGS. 14 and 16, from above into the voiding end 107 or 115, respectively, of the shovel tube 106.

A slip seal ring 111 lies against the outside surface of the end flange 108, and a thrust plate 76 that is supported against the stacking frame 1, and a shutoff device 94 are secured to this slip seal ring. Ahead of this [shutoff device—Tr] there is a connector flange that remains stationary relative to the stacking frame 1 as the container 31 rotates. Between the end flange 108 and the voiding end 107 of the shovel tube 106 there are stiffening plates 114.

FIG. 16 show a section through FIG. 14 in the direction indicated by the arrow XV/XV and the shape of the shovel tube 106, which can be welded up from preformed individual panels, for example.

FIG. 16 shows a very simple variation of the voiding system 115, in which a removal tube 112 that widens towards the outside and can be closed off by a simple union nut 113 is bolted onto the outer surface of the end flange 108. In both embodiments the shovel tube 105 widens out, preferably as a trumpet shape, between its filler end 109 and its voiding end 115. The voiding end 115 shown in FIG. 16 is configured somewhat differently, from the construction point of view, to the voiding end 107 shown in FIG. 14.

All the voiding systems 66, 81, and 105 work in conjunction with a pressure-equalising system 42, by means of which gas is introduced into the container as it is being voided. As is shown in FIGS. 10 to 13, this comprises a rotary gas duct 43, for which the rotary gas duct receptacle **43*a* is secured at the centre 41 of the pressure-equalising bottom 39. Connector lines 44 end in the rotary gas duct receptacle 43*a* and, as can be seen in FIG. 10, these pass outwards in a stellar arrangement through the gas ducts 45 which, as shown in FIGS. 11 and 12, are secured along the outer edge 39*a* of the pressure-equalising bottom 39 and make it possible to introduce gas into the interior of the container 31**.

The gas line 24 ends on the part 43 of the rotary gas duct that is arranged so as to be rotatable in the rotary gas duct receptacle **43*a*; this line can be connected with the gas cylinders 21 or with an air inlet valve 27 that is only shown schematically herein. Thus, dry air or dry inert gas from the cylinders 21, or atmospheric air, as required, can move into the rotary gas duct 43**.

The gas ducts 45 on the outer edge **39*a* of the pressure-equalising bottom 39 are combined with shutoff valves 46 that have, for example, an operating pushrod 47. As the container 31 rotates, these push rods 47 run in the upper area of their path on a control cam 47, shown schematically herein, so that the gas ducts 45** are opened in the upper area of the rotating container.

Without modifying any part of the concept of the present invention, in place of the rotary gas duct 43 and the gas ducts 45 with the shutoff valves 46 one can use other appropriate control elements.

In order to ground electrostatic voltages that can be generated as the container 31 rotates, this is grounded relative to its stacking frame in a manner known per se and not shown herein.

In preferred embodiments of the present invention the fillers 54, the voiding systems 66, 81, and 105, and the pressure equalisation system are so configured as to be hermetically sealed against the ingress of the atmosphere.

We claim:

1. A tubular container for bulk materials, preferably finally comminuted powders, rotatable about its longitudinal axis and supported in a stacking frame, comprising:

a rotary drive for rotating the container;

a pair of quadrilateral roller frames each having four rollers arranged so that one roller is in each corner of each of the frames, the roller frames being arranged so as to form a primary structural component of the stacking frame;

a container outer peripheral surface;

a container inner peripheral surface;

two roller rings for the rollers fastened on the outer peripheral surface each of the roller rings being arranged so as to coact with the four rollers in one of the roller frames;

a container emptying bottom having a central aperture therein;

an emptying system combined with the emptying bottom and including a passage through the central aperture of the emptying bottom the emptying system including one of a suction nozzle and paddle arrangement combined with a torque support;

a spiral worm fastened to the inner peripheral surface so as to transport the bulk material to the emptying system during rotation of the container;

at least one filling stub provided at the outer peripheral surface; and another container bottom opposite to the emptying system formed as a pressure-equalization base with gas passages of a pressure-equalization system located at an outer edge thereof.

2. A container as defined in claim 1, wherein the four rollers cooperating with each roller ring are one of revolving and support rollers, and further comprising a sprocket/chain drive including a drive ring arranged around the central aperture of the emptying bottom.

3. A container as defined in claim 1, wherein the four rollers of each roller frame include three rolling or support rollers and one drive wheel, each of the roller rings being in operative connection with the three revolving or support rollers and the one drive wheel, at least one of the drive wheels being connected to the rotary drive.

4. A container as defined in claim 3, wherein two roller rings per roller ring frame fastened next to each other on the container are provided for the revolving rollers and the drive wheels.

5. A container as defined in claim 4, wherein the drive wheels are equipped with a rotary crown of a hard rubber-like material.

6. A container as defined in claim 1, the rotary drive includes a hand crank and a stepdown gear box in rotary connection with the hand crank.

7. A container as defined in claim 1, and further comprising a transportation safety system (48) provided between the container and the stacking frame and including an upper and a lower container brake shoe (50) for each container bottom (37, 39), each lower container brake shoe, in a transportation position of the container (31), being opposite a frame brake shoe (51) that is secured to one of an upper and a lower crosspiece of the stacking frame (1).

8. A container as defined in claim 7, wherein the container brake shoe (50) and the frame brake shoe (51) are each located between stiffening plates (49, 52) that are joined to the stacking frame (1).

9. A container as defined in claim 8, wherein the stiffening plates (52) of each lower frame brake shoe (51) have upwardly extending members between which a pivoting shoe is supported so as to be pivotable into a space between the stiffening plates (49) of the opposite container brake shoe (50) in the transportation position.

10. A container as defined in claim 1, and further comprising fluidising paddles (56) provided in the spiral worm and arranged so as to offset relative to each other and extend in the direction of the longitudinal axis (32) of the container (31).

11. A container as defined in claim 10, wherein the spiral worm has a slope which decreases towards the emptying bottom (37).

12. A container as defined in claim 1, wherein the emptying system is a suction voiding system (66) in which the passage that passes through the emptying bottom (37) is a rotary duct (67), at the outer end of which there is a suction connection (78) and at the inner end of which there is a suction nozzle (68) that is directed downwards even when the container is rotating, the suction nozzle having a lower end (73) in a bulk-material collection area (58).

13. A container as defined in claim 12, wherein the rotary duct (67) includes a bearing tube (60) that projects into the interior of the container (31), with an outer flange (61) flanged onto a reinforcing ring (40) of the central aperture (38) of the emptying bottom (37) and a passage tube (62) sealed into and rotatable within the bearing tube (60).

14. A container as defined in claim 13, wherein an inner flange (63) is secured on the bearing tube (60); and further comprising stiffening ribs (64) provided between the outer flange (61) and the bearing tube (60).

15. A container as defined in claim 14, wherein the suction nozzle (68) has an upper end (68*a*) connected rigidly to a head (72) that is installed on a part of the passage tube (62) that extends beyond the inner flange (63) of the bearing tube (60).

16. A container as defined in claim 15, wherein the portion of the passage tube (62) that extends beyond the inner flange (63) of the bearing tube (60) has a lower section; and further comprising an end plate (96) welded to a remaining partial surface of the passage tube (62*a*).

17. A container as defined in claim 16; and further comprising screws (98) provided so as to secure the head (72) to the end plate (96) on the passage tube (62).

18. A container as defined in claim 15; and further comprising a bearing and sealing ring (97) arranged on a side of the head (72) that is proximate to the inner flange (63) of the bearing tube (60) so as to abut against the inner flange (63) of the bearing tube (60) which is also configured as a bearing and sealing ring (63*a*).

19. A container as defined in claim 15, wherein the suction nozzle (68) consists of parallel suction tubes (70) of square cross-section (71); and further comprising a pressure-contact roller (75) arranged so as to run on the emptying bottom (37) and secured to its lower area.

20. A container as defined in claim 15, wherein the suction nozzle (68) has inlet and outlet edges which together with the edges of the head (72) are surrounded by an edge (99) of triangular cross-section.

21. A container as defined in claim 13, wherein the torque support is supported against the stacking frame (1) and is secured on an outer end of the passage tube (62) which extends beyond the outer flange (61) of the bearing tube (60).

22. A container as defined in claim 21, and further comprising a spacer ring (65) at the outer end of the passage tube (62), between the outer flange (61) of the bearing tube (60) and the torque support (76) provided so as to abut against a bearing and sealing surface (61*a*) of the outer flange (61), and grub screws (76*a*) set in the torque support (76) so as to adjust a distance of the spacer ring (65) from the torque support (76).

23. A container as defined in claim 12, wherein the suction connection includes a flange (78) secured on the torque support (76) by bolts (80); and further comprising a shutoff device (72) interposed between them.

24. A container as defined in claim 1, wherein the emptying system is a mechanical emptying system (81) with a paddle arrangement (83) that is secured to an inner side of the emptying bottom (37), the passage through the emptying bottom (37) being a rotary duct (82) having an outer end to which a voiding opening (87) is connected and an inner end to which an arrangement to remove the bulk material (85, 90, 91) is connected with a filler opening (86) located above.

25. A container as defined in claim 24, wherein the rotary duct (82) comprises a rim (88) that is flanged-fitted to a reinforcement ring (40) of the central aperture (38) in the emptying bottom (37) and which has an inner and an outer bearing and sealing ring (88*a*, 88*b*).

26. A container as defined in claim 25, wherein the arrangement for bulk-material removal comprises a sharp-edged passage tube (90, 91) that widens inwardly, a step-up ring (92) configured as a bearing and sealing ring arranged so as to abut against the inner bearing and sealing ring (88*b*) of the rim (88), the arrangement further including a passage tube (90) which extends outwardly and has an outer-end flange (100), in which the torque support (76) that is supported against the stacking frame (1) is flanged.

27. A container as defined in claim 26, and further comprising a spacer ring (10) between the outer-end flange (100) and the outer bearing and sealing ring (88*a*) of the rim (88), and grub screws (76) provided so as to adjust the distance of the spacer ring (101) from the torque support (76).

28. A container as defined in claim 24, and further comprising a shutoff device (94) fitted to the torque support (76), the voiding opening (87) being arranged beneath the center in the front plate with the torque support (76), the arrangement for removal of the bulk material (90, 91) being connected with the filler opening (86) by a delivery pipe (85) which, when used for fine powders, widens out in a trumpet form towards the voiding opening (87).

29. A container as defined in claim 24, wherein the paddle arrangement (83) comprises at least one voiding paddle with a scoop edge (84) that extends within a bulk-material collection area (58) in a common direction to the inner peripheral surface (34) of the container (31).

30. A container as defined in claim 29, wherein the paddle arrangement (83) has a plurality of voiding paddles that are welded up from curved panels (102), the scoop edges (84*a*) being provided so as to open out tangentially in the inner peripheral surface (34) of the container (31) and of the emptying bottom (37), the paddles having voiding ends (84*b*) arranged so as to be perpendicular to the widened section (91) of the passage tube of the arrangement for removing the bulk material, and are defined against the inside of the container (31) by baffles (103).

31. A container as defined in claim 1, wherein the emptying system is a mechanical system (105) with a shovel tube (106) having a voiding end (107, 115) which is passed coaxially through the emptying bottom (37)

and which has an end flange (108) that is bolted to a reinforcing ring (40) of the central aperture (38), the shovel tube further having a filler end (109) which is formed as a shovel that lies tangentially against the inner peripheral surface (34) on the container (31).

32. A container as defined in claim 31, and further comprising a slip-ring seal (111) provided against the outer face of the end flange (108) and on which the torque support (76) that is supported against the stacking frame (1) and a shutoff device (94) are secured.

33. A container as defined in claim 31, wherein the end flange (108) has an outer surface; and further comprising a removal pipe (112) that widens outwardly and is closable by a gland nut (113), the removal pipe being secured to the outer surface of the end flange (108).

34. A container as defined in claim 31, wherein the shovel tube (106) has a outwardly widening cross-section in a trumpet shape, between its filling end (109) and its voiding end (107, 115).

35. A container as defined in claim 31; and further comprising stiffening panels (114) secured between the end flange (108) of the shovel tube (106) and its voiding end (107, 115).

36. A container as defined in claim 1, wherein the pressure-equalization system (42) comprises a gas duct (43, 43*a*) having a gas duct receptacle secured in the center (41) of the pressure-equalization base (39), connector lines (44) that extend outwardly in a stellar arrangement so as to connect the gas duct receptacle to the gas passages (45) located at the outer edge (39*a*) of the pressure-equalization base (39), and a gas line (24) connected to a part (43) of the gas duct, that is fixed relative to the stacking frame (1).

37. A container as defined in claim 36, wherein the gas line (24) is connected with one of pneumatic cylinders (21) that are arranged in the stacking frame and an air inlet valve (27).

38. A container as defined in claim 36, wherein each gas passage (45) is combined with a shutoff valve (46, 47) arranged so as to open for a specific gasification interval when in a top part of its rotary path.

39. A container as defined in claim 37; and further comprising an $O_2$ monitoring point (59) within the container that is electrically connected with shutoff valves (22) on the pneumatic cylinders (21).

40. A container as defined in claim 38, wherein the shutoff valve (46) has an operating pushrod (47) arranged so as to lie on a control cam (47*a*) for the duration of the gasification interval.

41. A container as defined in claim 1, wherein the rotary drive includes a circuit having a switch, the torque support (76) being operationally connected to the switch (77) in the rotary drive circuit.

42. A container as defined in claim 1, wherein the container is grounded relative to the stacking frame (1).

43. A container as defined in claim 1, wherein the at least one filling stub (54), the emptying system (66, 81, 105) and the pressure-equalization system (42) are so configured as to be hermetically sealed against atmospheric ingress.

* * * * *